US007786833B2

(12) United States Patent
Murakami

(10) Patent No.: US 7,786,833 B2
(45) Date of Patent: Aug. 31, 2010

(54) EDGEWISE COIL

(75) Inventor: Takao Murakami, Kyoto-fu (JP)

(73) Assignee: Suncall Corporation (JP)

( * ) Notice: Subject to any disclaimer, the term of this patent is extended or adjusted under 35 U.S.C. 154(b) by 436 days.

(21) Appl. No.: 11/997,091

(22) PCT Filed: Jul. 11, 2006

(86) PCT No.: PCT/JP2006/313714

§ 371 (c)(1),
(2), (4) Date: Jan. 28, 2008

(87) PCT Pub. No.: WO2007/013288

PCT Pub. Date: Feb. 1, 2007

(65) Prior Publication Data

US 2010/0141373 A1 Jun. 10, 2010

(30) Foreign Application Priority Data

Jul. 28, 2005 (JP) ..... 2005-219503

(51) Int. Cl.
*H01F 21/06* (2006.01)
*H01F 27/28* (2006.01)

(52) U.S. Cl. ..... 336/130; 336/131; 336/134; 336/170

(58) Field of Classification Search ..... 336/180–184, 336/223, 232, 200
See application file for complete search history.

(56) References Cited

U.S. PATENT DOCUMENTS 1,801,214 A * 4/1931 Von Henke ..... 336/223
6,903,645 B2 * 6/2005 Mizoguchi et al. ..... 336/200
7,142,082 B2 * 11/2006 Kakehashi et al. ..... 336/182

(Continued)

FOREIGN PATENT DOCUMENTS

JP 51-018918 2/1976

(Continued)

OTHER PUBLICATIONS

International Search Report for PCT/JP2006/313714 mailed Sep. 26, 2006, 1 pg.

(Continued)

*Primary Examiner*—Anh T Mai
(74) *Attorney, Agent, or Firm*—Sterne, Kessler, Goldstein & Fox P.L.L.C.

(57) ABSTRACT

An edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, wherein the pair of long sides include, in a longitudinal cross section in a pre-bending-process state before the shaped conductor wire is bended, a pair of straight-line regions extending from both ends of the second sides so as to be parallel to each other and a pair of tapered regions extending between the straight-line regions and the first short side, and the pair of tapered regions, in a longitudinal cross section in the pre-bending-process state, come closer to each other as they approach the first short side.

14 Claims, 9 Drawing Sheets

U.S. PATENT DOCUMENTS

| | | | | |
|---|---|---|---|---|
| 7,221,250 | B2 * | 5/2007 | Yoshida et al. | 336/200 |
| 7,397,334 | B2 * | 7/2008 | Yoshida et al. | 336/200 |
| 2005/0012581 | A1 * | 1/2005 | Ono et al. | 336/90 |

FOREIGN PATENT DOCUMENTS

| | | | |
|---|---|---|---|
| JP | 54-106824 | | 8/1979 |
| JP | 08-124760 | | 5/1996 |
| JP | 2002-222724 | A | 8/2002 |
| JP | 2005-019618 | A | 1/2005 |
| JP | 2005294427 | A * | 10/2005 |

OTHER PUBLICATIONS

The Notification of Reasons for Rejection for corresponding Japanese patent Appl. No. 2005-219503, (with English translation) Japanese Patent Office, mailed Oct. 16, 2009, 4 pgs.

International Preliminary Report on Patentability for PCT/JP2006/313714, issued Jan. 29, 2008, 4 pgs.

* cited by examiner

EDGEWISE COIL

BACKGROUND OF THE INVENTION

The present invention relates to an edgewise coil which includes a non-circular cross-sectional shaped conductor having a cross-sectional shape defined by a pair of long sides and a pair of first and second short sides, the shaped conductor wire being laminated while being bended with using the first short side as a bending fulcrum so as to form a plurality of laminated wire layers having a rectangular shape in a plan view. The edgewise coil is usable, for example, as a reactor coil used in a step-up circuit of a dynamic power system such as a motor or a power generator.

DESCRIPTION OF THE RELATED ART

There has been a conventional edgewise coil which includes a non-circular cross-sectional shaped conductor wire having a cross-sectional shape defined by a pair of long sides and a pair of first and second short sides, the shaped conductor wire being laminated while being bended with using the first short side as a bending fulcrum so as to form a plurality of laminated wire layers having a rectangular shape in a plan view. The edgewise coil is usable, for example, as a reactor coil used in a step-up circuit of a dynamic power system such as a motor or a power generator by having an iron core inserted within the coil.

DISCLOSURE OF THE INVENTION

Such a conventional edgewise coil raises the following problem. FIG. 9 shows a conventional edgewise coil A. FIG. 9(A) is a perspective view thereof; FIG. 9(B) is a cross-sectional view which is taken along a line B-B' in FIG. 9(A) and in which the non-circular cross-sectional shaped conductor wire of the conventional edgewise coil A is cut at a straight line part; and FIG. 9(C) is a cross-sectional view which is taken along a line C-C' in FIG. 9(A) and in which the shaped conductor wire is cut at a position Q corresponding to the bending fulcrum. Here, in FIG. 9, the symbols A', A1, and A2 represent the shaped conductor wire, the first short side of the shaped conductor wire A', and the second short side of the shaped conductor wire A', respectively. Also, although not illustrated in FIG. 9(A), laminated parts of the edgewise coil A respectively positioned on left and right sides are connected with each other at their lower ends.

In the conventional edgewise coil A shown in FIG. 9, as shown in FIG. 9(C), the stress is concentrated on an inner circumference side (C' side in the Figure) at the position Q corresponding to the bending fulcrum due to plastic deformation of the shaped conductor wire A' at the time of the bending process, so that an expansion (bridge) D is occurred outward in a thickness direction (X direction in the Figure) at the inner circumference side (to generate a so-called bridge phenomenon), whereby a thickness T' on the inner circumference C' side tends to be larger than a thickness T of the shaped conductor wire A' before the bending process. Then, as shown in FIG. 9(B), even in the straight line part, a gap E is occurred between adjacent shaped conductor wires A' and A' in a laminating direction, due to the expansion D at the position Q corresponding to the bending fulcrum. As a result, the length L' (hereafter referred to as closely-contacted-state length) of the edgewise coil in the thickness direction X (in other words, the direction along which the shaped conductor wire A' of the edgewise coil A is laminated) will be elongated and, in accordance with that amount, the large space for housing an apparatus or the like on which the edgewise coil A is mounted will be required. Further, the iron core that is inserted into the coil must be elongated in accordance with the elongation of the closely-contacted-state length L' of the edgewise coil A, and a casing for housing the edgewise coil A is needed to have a larger scale, resulting in increased cost of members having sizes depending on the closely-contacted-state length L'. The negative effect will be larger according as the number of the turns of the coil increases. Here, although a coating resin member is not illustrated, the same applies as described above even in consideration of a thickness of the coating resin member.

Therefore, it is an object of the present invention to provide an edgewise coil which includes a non-circular cross-sectional shaped conductor wire having a cross-sectional shape defined by a pair of long sides and a pair of first and second short sides, the shaped conductor wire being laminated while being bended with using the first short side as a bending fulcrum so as to have a plurality of laminated wire layers having a rectangular shape in a plan view, the edgewise coil capable of being compacted, thereby saving space of the apparatus or the like on which the edgewise coil is mounted, and capable of achieving cost reduction of members having sizes that depends on the closely-contacted-state length of the edgewise coil, such as shortening and weight reduction of the iron core to be inserted and scale reduction of the casing for housing or the like.

The present invention provides, in order to achieve the object, following first to fourth edgewise coil.

(1) A First Edgewise Coil

The present invention provides an edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, wherein the pair of long sides include, in a longitudinal cross section in a pre-bending-process state before the shaped conductor wire is bended, a pair of straight-line regions extending from both ends of the second sides so as to be parallel to each other and a pair of tapered regions extending between the straight-line regions and the first short side, and the pair of tapered regions, in a longitudinal cross section in the pre-bending-process state, come closer to each other as they approach the first short side.

(2) A Second Edgewise Coil

The present invention further provides an edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, wherein the pair of long sides include, in a longitudinal cross section in a pre-bending-process state before the shaped conductor wire is bended, a pair of tapered regions extending between both ends of the second short side and both ends of the first short side, and the pair of tapered regions, in a longitudinal cross section in the pre-bending-process state, come closer to each other as they approach the first short side.

(3) A Third Edgewise Coil

The present invention still further provides an edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, wherein the pair of long sides include, in a longitudinal cross section in a pre-bending-process state before the shaped conductor wire is bended, a pair of first straight-line regions extending from both ends of the second sides so as to be parallel to each other and a pair of second straight-line regions extending between the pair of first straight-line regions and the first short side, and the pair of second straight-line regions are closer to each other than the pair of first straight-line regions.

(4) A Fourth Edgewise Coil

The present invention still further provides an edgewise coil which includes a non-circular cross-sectional shaped conductor having a cross-sectional shape defined by first and second width-direction surfaces extending substantially parallel to each other in a state of being spaced apart from each other by T in a thickness direction and in a state of being along both a width direction and a longitudinal direction and first and second thickness-direction surfaces extending substantially parallel to each other in a state of being spaced apart from each other by W which is longer than T in the width direction and in a state of being along both the thickness direction and the longitudinal direction, the shaped conductor wire being laminated while being bended with using a predetermined position of the first thickness-direction surface in the longitudinal direction as a bending fulcrum so as to form a plurality of laminated wire layers having a rectangular shape in a plan view, wherein the shaped conductor wire has, in a pre-bending-process state before the shaped conductor wire is bended, a pair of recesses disposed at a position corresponding to the bending fulcrum in the longitudinal direction, the pair of recesses respectively extending from the first and second width-direction surfaces to the first thickness-direction surface.

With the first to fourth edgewise coils according to the present invention, it is possible to achieve following effects.

That is, even if due a stress is concentrated on an inner circumference side at the position corresponding to the bending fulcrum at the time of the bending process due to the plastic deformation of the shaped conductor wire and the shaped conductor wire is accordingly expanded outward in the thickness direction, this expansion is occurred in the pair of taper regions in the first and second edgewise coils; the expansion is occurred in the pair of second straight-line regions in the third edgewise coil; and the expansion is occurred in the recess parts in the fourth edgewise coil. Therefore, the thickness on the inner circumference side can be approximated to or can be reduced to be lower than (preferably can be made approximately equal to) the thickness of the shaped conductor wire in the pre-bending-process state. Accordingly, a gap, which may be caused due to the expansion at the position corresponding to the bending fulcrum, can be eliminated or can be reduced to be almost none between adjacent shaped conductor wires in the laminated state, so that a closely-contacted-state length of the each of the first to fourth edgewise coils in the thickness direction of the shaped conductor wire L can be shortened, and a space of an apparatus or the like on which the edgewise coils are mounted can be saved for that amount. Also, an iron core inserted into the coil can be shortened in correspondence with the closely-contacted-state length of the edgewise coils and can be reduced in weight for that amount. Further, reduction of the costs of the members having sizes depending on the closely-contacted-state length, such as scale reduction of the casing for housing the edgewise coils, can be achieved.

The first to fourth edgewise coils preferably have configurations capable of dispersing the stress concentration on the inner circumference side of the shaped conductor wires at the position corresponding to the bending fulcrum due to plastic deformation of the shaped conductor wire at the time of the bending process so that the outward expansion of the shaped conductor wire is effectively prevented from being expanded in the thickness direction. For example, the first to third edgewise coils is preferably configured so that the first short side is formed at a recess opening outward at a middle portion between both ends, and the fourth edgewise coil is preferably configured so that the pair of recesses have spherical shapes in which the position corresponding to the bending fulcrum are recessed most deeply.

In order to prevent the thickness of the shaped conductor wire at the inner circumference side at the position corresponding to the bending fulcrum from exceeding the thickness of the shaped conductor wires in the pre-bending-process state, the first to fourth edgewise coil are preferably configured so that the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

As explained above, the present invention provides an edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, the edgewise coil capable of being compacted, thereby saving space of the apparatus or the like on which the edgewise coil is mounted, and capable of achieving cost reduction of members having sizes depending on the closely-contacted-state length of the edgewise coil, such as shortening and weight reduction of the iron core to be inserted and scale reduction of the casing for housing or the like.

Further, the edgewise coil according to the present invention is capable of improving contact property between the plurality of laminated wire layers, thereby increasing a number of the laminated wire layers to enhance a gain without enlarging its volume.

BRIEF DESCRIPTION OF THE DRAWINGS

FIG. 2(A) is a cross-sectional view which is taken along a line B-B' in FIG. 1 and in which a non-circular cross-sectional shaped conductor wire forming the first edgewise coil is cut at a straight line part; FIG. 2(B) is an enlarged cross-sectional view of a part of FIG. 2(A); FIG. 2(C) is a cross-sectional view which is taken along a line C-C' in FIG. 1 and in which the shaped conductor wire is cut at a position corresponding to a bending fulcrum; and FIG. 2(D) is an enlarged cross-sectional view of a part of FIG. 2(C). FIG. 2(E) is a cross-sectional view of a conventional edgewise coil for comparison with the conventional art, which is taken along a line C-C' in FIG. 9 and in which a non-circular cross-sectional shaped conductor wire of the conventional edgewise coil shown in FIG. 9 is cut at a position corresponding to the bending fulcrum.

FIG. 3(A) is a cross-sectional view which is taken along the line B-B' of FIG. 1 and in which a non-circular cross-sectional shaped conductor wire forming the second edgewise coil is cut at a straight line part; FIG. 3(B) is an enlarged cross-sectional view of a part of FIG. 3(A); FIG. 3(C) is a cross-sectional view which is taken along the line C-C' of FIG. 1 and in which the shaped conductor wire is cut at the position corresponding to the bending fulcrum; and FIG. 3(D) is an enlarged cross-sectional view of a part of FIG. 3(C). FIG. 3(E) is a cross-sectional view of a conventional edgewise coil for comparison with the conventional art, which is taken along the line C-C' in FIG. 9 and in which the shaped conductor wire of the conventional edgewise coil shown in FIG. 9 is cut at the position corresponding to the bending fulcrum.

FIG. 4(A) is a cross-sectional view which is taken along the line B-B' of FIG. 1 and in which a non-circular cross-sectional shaped conductor wire forming the third edgewise coil 30 is cut at a straight line part; FIG. 4(B) is an enlarged cross-sectional view of a part of FIG. 4(A); FIG. 4(C) is a cross-sectional view which is taken along the line C-C' of FIG. 1 and in which the shaped conductor wire is cut at the position corresponding to the bending fulcrum; and FIG. 4(D) is an enlarged cross-sectional view of a part of FIG. 4(C). FIG. 4(E) is a cross-sectional view of a conventional edgewise coil for comparison with the conventional art, which is taken along the line C-C' in FIG. 9 and in which the shaped conductor wire forming the conventional edgewise coil shown in FIG. 9 is cut at the position corresponding to the bending fulcrum.

FIG. 5(A) is a cross-sectional view which is taken along the line B-B' of FIG. 1 and in which a non-circular cross-sectional shaped conductor wire forming the fourth edgewise coil is cut at a straight line part; FIG. 5(B) is an enlarged cross-sectional view of a part of FIG. 5(A); FIG. 5(C) is a cross-sectional view which is taken along the line C-C' of FIG. 1 and in which the shaped conductor wire is cut at a predetermined position in a longitudinal direction Z; FIG. 5(D) is an enlarged cross-sectional view of a part of FIG. 5(C); and FIG. 5(E) is an enlarged cross-sectional view in which the shaped conductor wire, in the pre-bending-process state before performing the bending process, is cut at the position corresponding to the bending fulcrum. FIG. 5(F) is a cross-sectional view of a conventional edgewise coil for comparison with the conventional art, which is taken along the line C-C' in FIG. 9 and in which the shaped conductor wire of the conventional edgewise coil shown in FIG. 9 is cut at the position corresponding to the bending fulcrum.

FIG. 6(A) is a schematic side view showing one example of a transporting step for transporting a mother material having a circular cross-sectional shape; FIG. 6(B) is a schematic side view showing one example of a forming step for forming the first to third shaped conductor wires from the mother material having the circular cross-sectional shape with use of first to third dices; FIG. 6(C) is a schematic front view of the first dice for forming the first shaped conductor wire as viewed in an opening direction; FIG. 6(D) is a schematic front view of the second dice for forming the second shaped conductor wire as viewed in an opening direction; FIG. 6(E) is a schematic front view of the third dice for forming the third shaped conductor wire as viewed in an opening direction; FIG. 6(F) is a schematic plan view showing one example of a bending process step for laminating the respective first to third shaped conductor wires while performing a bending process on them so that the respective first to third shaped conductor wires form a plurality of laminated wire layers having a rectangular shape in a plan view; FIG. 6(G) is a schematic plan view showing another example of the bending process step; FIG. 6(H) is a perspective view showing the bending process step shown in FIG. 6(G); and FIG. 6(I) is a schematic cross-sectional view of a pin member used in the bending process steps shown in FIG. 6(G) and FIG. 6(H).

FIG. 7(A) is a schematic side view showing one example of a transporting step for transporting the mother material having a circular cross section; FIG. 7(B) is a schematic side view showing one example of a forming step for forming the fourth shaped conductor wire from the mother material having a circular cross section with use of a fourth dice; FIG. 7(C) is a schematic front view of the fourth dice for forming the fourth shaped conductor wire as viewed in the opening direction; FIG. 7(D) is a schematic side view showing one example of a recess forming step for forming a pair of recesses with use of a pair of pressing members and a restriction member and showing a state before forming the pair of recesses; FIG. 7(E) is a schematic side view showing a state in which the pair of recesses are being formed; FIG. 7(F) is a schematic side view showing the other example of the recess forming step in which the pair of first and second pressing members respectively press first and second width-direction surfaces of the fourth shaped conductor wire in a state that the pair of first and second pressing members do not extend beyond the first thickness-direction surface; FIG. 7(G) is a schematic perspective view showing a step for cutting apex parts of the fourth shaped conductor wire which are occurred on a side close to the first thickness-direction surface than the pair of recesses in the width direction as a result of the formation of the pair of recesses by the example shown in FIG. 7(G); FIG. 7(H) is a schematic plan view of the shaped conductor wire of the fourth edgewise coil as viewed from a plane, in the pre-bending-process state before performing the bending process; and FIG. 7(I) is a schematic side view of the shaped conductor wire as viewed from a side of the first thickness-direction surface.

FIG. 8(A) is a schematic plan view showing one example of a bending process step in which the fourth shaped conductor wire is laminated while being bended so as to form a plurality of laminated wire layers; FIG. 8(B) is a schematic plan view showing another example of the bending process step; FIG. 8(C) is a perspective view of the bending process step shown in FIG. 8(B); and FIG. 8(D) is a schematic cross-sectional view of a pin member used in the bending process step shown in FIG. 8(B) and FIG. 8(C).

FIG. 9(A) is a perspective view thereof; FIG. 9(B) is a cross-sectional view which is taken along a line B-B' in FIG. 9(A) and in which a non-circular cross-sectional shaped conductor wire of the conventional edgewise coil is cut at a straight line part; and FIG. 9(C) is a cross-sectional view which is taken along the line C-C' in FIG. 9(A) and in which the shaped conductor wire is cut at a position corresponding to the bending fulcrum.

DESCRIPTION OF REFERENCE NUMERALS

Figure 1:
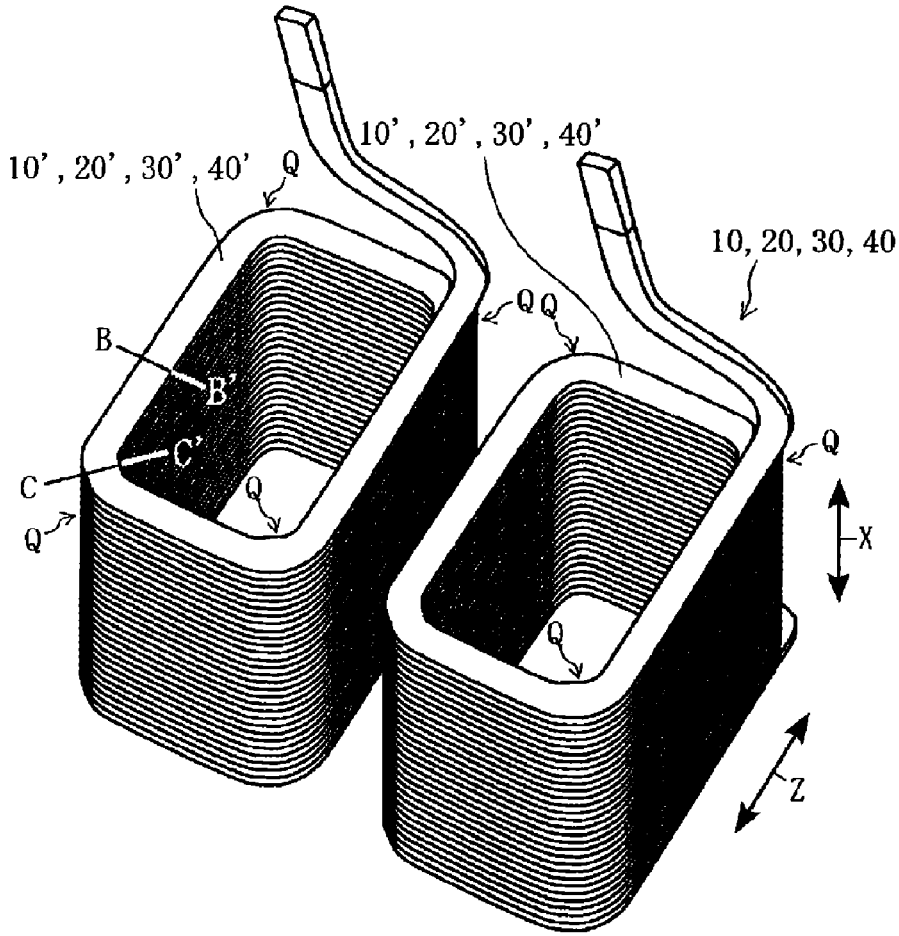
FIG. 1 is a perspective view showing first to fourth edgewise coils according to first to fourth embodiments of the present invention.

10, 20, 30, 40 edgewise coil
10', 20', 30', 40' non-circular cross-sectional shaped conductor wire
11, 12 a pair of first and second long sides
11*a*, 12*a* a pair of straight-line regions
11*b*, 12*b* a pair of tapered regions
13, 14 a pair of short sides
13*a* recess
21, 22 a pair of first and second long sides
21*b*, 22*b* a pair of tapered regions
23, 24 a pair of first and second short sides
31, 32 a pair of first and second long sides
31*a*, 32*a* a pair of first straight-line regions
31*b*, 32*b* a pair of second straight-line regions
33, 34 a pair of first and second short sides
41, 42 first and second width-direction surfaces
43, 44 first and second thickness-direction surfaces
45, 46 a pair of recesses
700 pin member
710 first restriction flange
720 second restriction flange
P middle region of the first short side positioned between its both ends
Q position corresponding to a bending fulcrum
X thickness direction
Y width direction
Z longitudinal direction

BEST MODE FOR CARRYING OUT THE INVENTION

Hereafter, embodiments of the present invention will be described with reference to the drawings. FIG. 1 is a perspective view showing first to fourth edgewise coils 10, 20, 30, 40 according to the first to fourth embodiments of the present invention. Here, although not illustrated in the Figure, laminated parts on left and right sides in these edgewise coils 10, 20, 30, 40 are connected with each other at the lower ends.

First Embodiment

Figure 2:
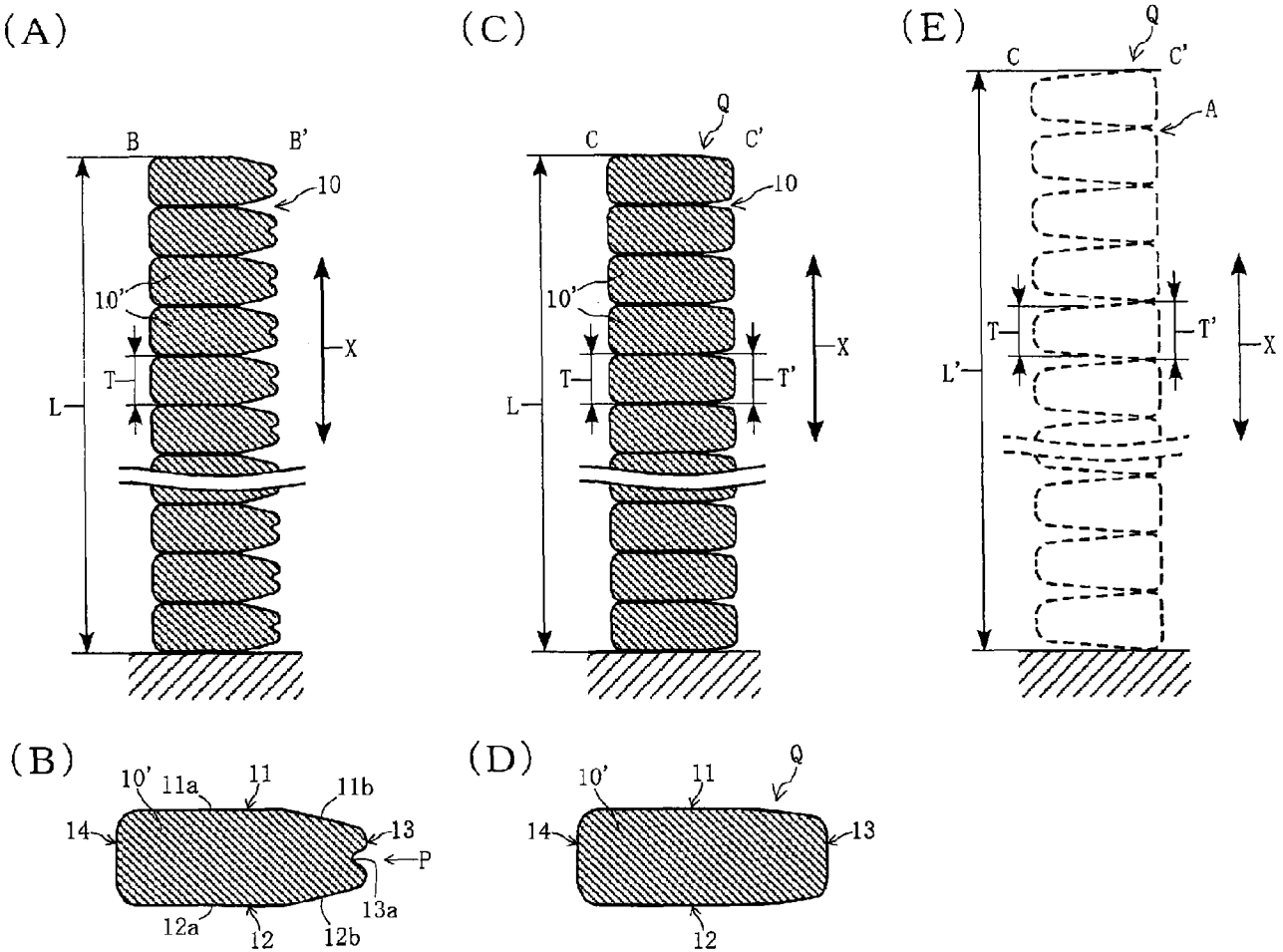
FIG. 2 is a view showing the first edgewise coil according to the first embodiment of the present invention.
Figure 9:
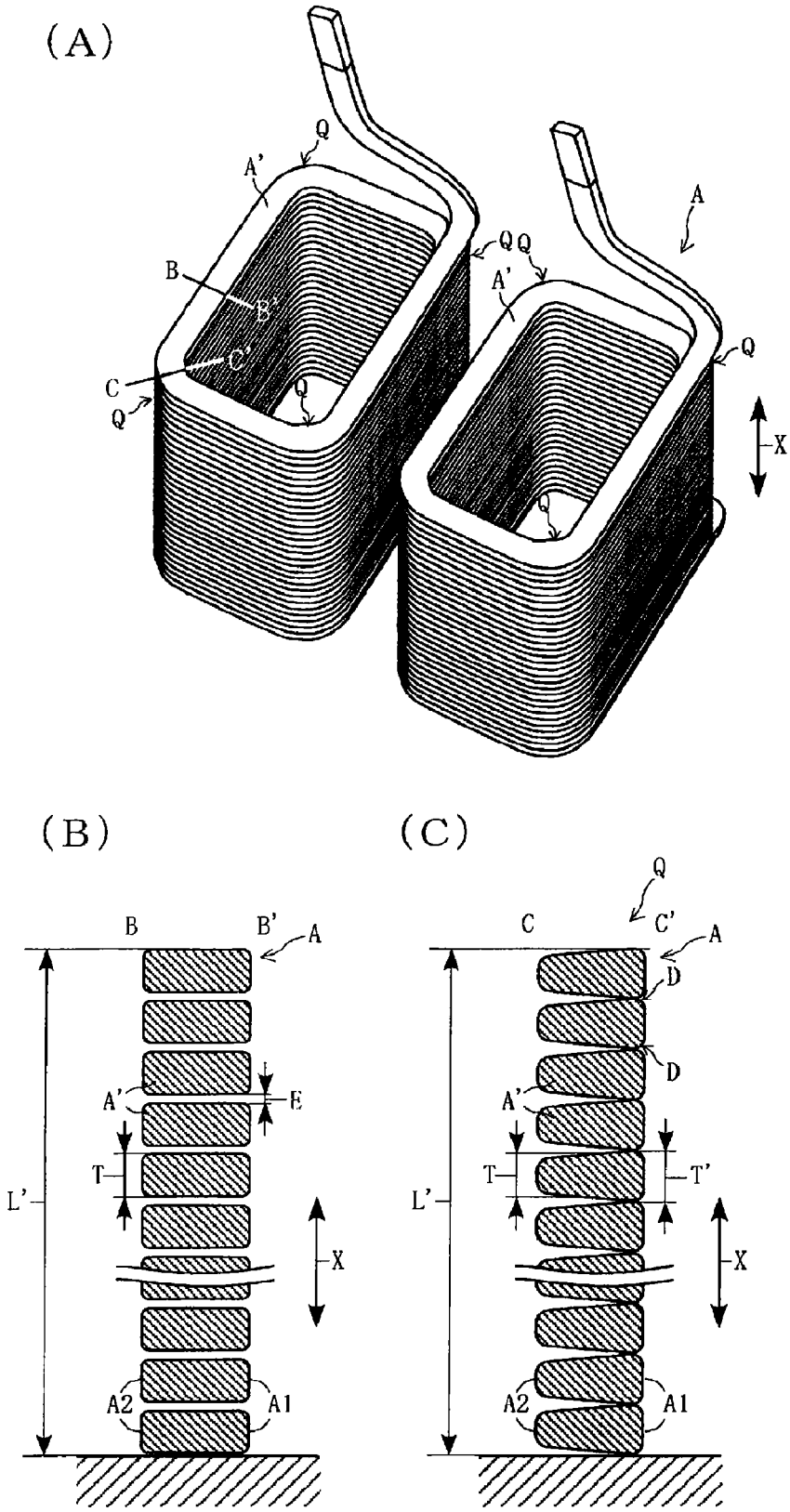
FIG. 9 is a view showing the conventional edgewise coil.

FIG. 2 is a view showing the first edgewise coil 10 according to the first embodiment of the present invention. FIG. 2(A) is a cross-sectional view which is taken along a line B-B' in FIG. 1 and in which a non-circular cross-sectional shaped conductor wire 10' forming the first edgewise coil 10 is cut at a straight line part; FIG. 2(B) is an enlarged cross-sectional view of a part of FIG. 2(A); FIG. 2(C) is a cross-sectional view which is taken along a line C-C' in FIG. 1 and in which the shaped conductor wire 10' is cut at a position Q corresponding to a bending fulcrum; and FIG. 2(D) is an enlarged cross-sectional view of a part of FIG. 2(C). Here, for comparison with a conventional art, FIG. 2(E) shows, in broken lines, a cross-sectional view which is taken along the line C-C' and in which a non-circular cross-sectional shaped conductor wire A' of the conventional edgewise coil A shown in FIG. 9 is cut at a position Q corresponding to the bending fulcrum. Also, in each of the edgewise coils shown in FIG. 2, and FIGS. 3 to 5 described later and the drawings related thereto, a coated resin member for covering the shaped conductor wire is not illustrated.

The first edgewise coil 10 shown in FIG. 2 includes the non-circular cross-sectional shaped conductor wire 10' which has a cross-sectional shape defined by a pair of long sides 11, 12 and a pair of first and second short sides 13, 14 and which is laminated while being bended with using the first short side 13 as the bending fulcrum so as to form a plurality of laminated wire layers having a rectangular shape in a plan view, wherein, in a longitudinal cross-sectional view in a pre-bending-process state before performing the bending process, the pair of long sides 11, 12 have a pair of straight-line regions 11*a*, 12*a* extending approximately in parallel to each other from the both ends of the second short side 14 and a pair of taper regions 11*b*, 12*b* respectively extending between the pair of straight-line regions 11*a*, 12*a* and the both ends of the first short side 13, and the pair of taper regions 11*b*, 12*b* come closer to each other according as they approach the first short side 13 in a longitudinal cross-sectional view in the pre-bending-process state, and the first short side 13 is formed with a recess 13*a* that opens outward at a middle region P between the both ends in the pre-bending-process state (See FIG. 2(B)).

Second Embodiment

Figure 3:
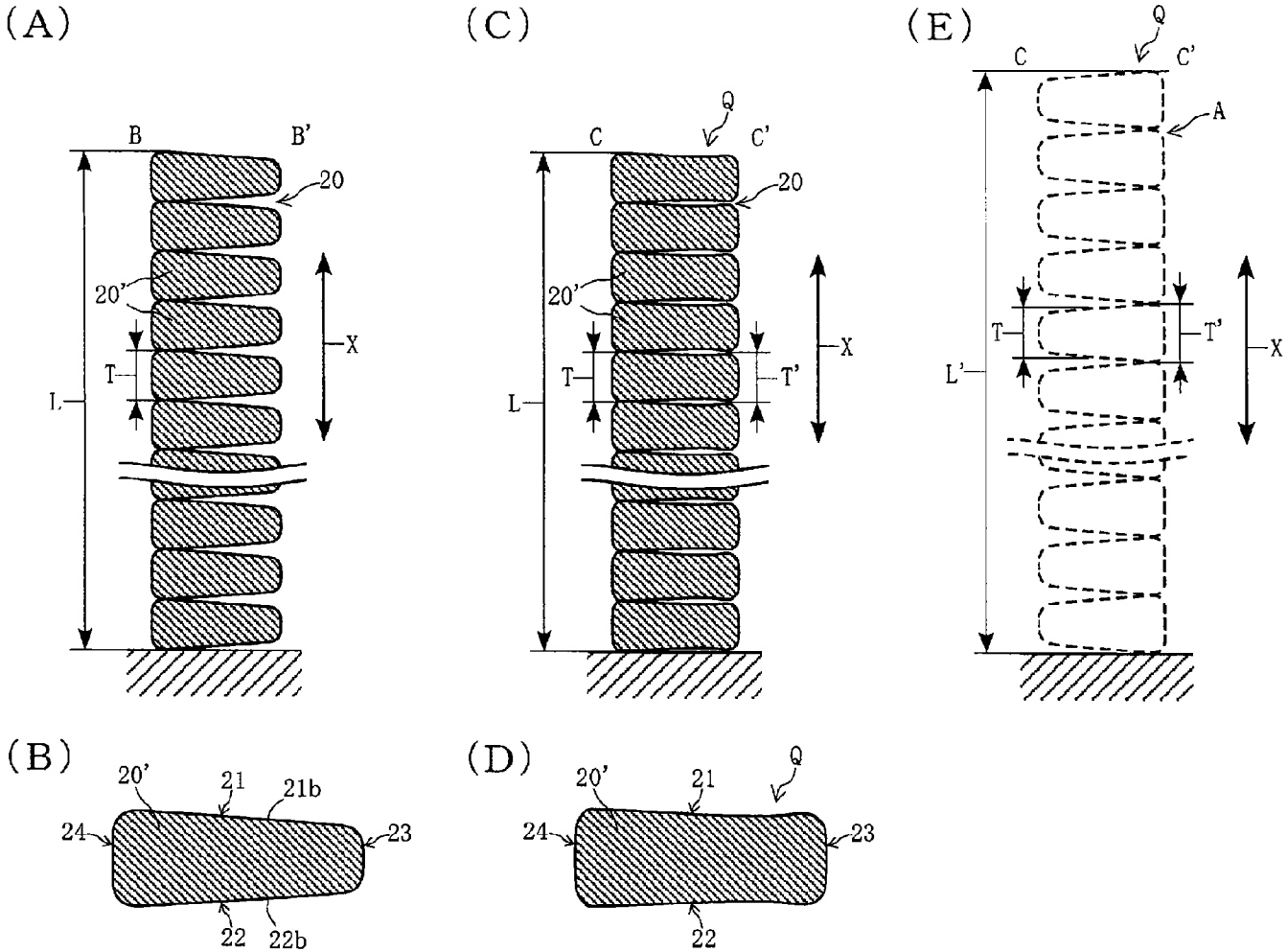
FIG. 3 is a view showing the second edgewise coil according to the second embodiment of the present invention.

FIG. 3 is a view showing the second edgewise coil 20 according to the second embodiment of the present invention. FIG. 3(A) is a cross-sectional view which is taken along the line B-B' of FIG. 1 and in which a non-circular cross-sectional shaped conductor wire 20' forming the second edgewise coil 20 is cut at a straight line part; FIG. 3(B) is an enlarged cross-sectional view of a part of FIG. 3(A); FIG. 3(C) is a cross-sectional view which is taken along the line C-C' of FIG. 1 and in which the shaped conductor wire 20' is cut at the position Q corresponding to the bending fulcrum; and FIG. 3(D) is an enlarged cross-sectional view of a part of FIG. 3(C). Here, for comparison with the conventional art, FIG. 3(E) shows, in broken lines, a cross-sectional view which is taken along the line C-C' and in which the shaped conductor wire A' of the conventional edgewise coil A shown in FIG. 9 is cut at the position Q corresponding to the bending fulcrum.

The second edgewise coil 20 shown in FIG. 3 includes the non-circular cross-sectional shaped conductor wire 20' which has a cross-sectional shape defined by a pair of long sides 21, 22 and a pair of first and second short sides 23, 24 and which is laminated while being bended with using the first short side 23 as the bending fulcrum so as to form a plurality of laminated wire layers having a rectangular shape in a plan view, wherein the pair of long sides 21, 22, in a longitudinal cross-sectional view in a pre-bending-process state before performing the bending process, have a pair of taper regions 21*b*, 22*b* respectively extending between both ends of the second short sides 24 and both ends of the first short sides 23, and the pair of taper regions 21*b*, 22*b* come closer to each other in a longitudinal cross-sectional view according as they approach the first short side 23 in the pre-bending-process state (See FIG. 3(B)).

Third Embodiment

Figure 4:
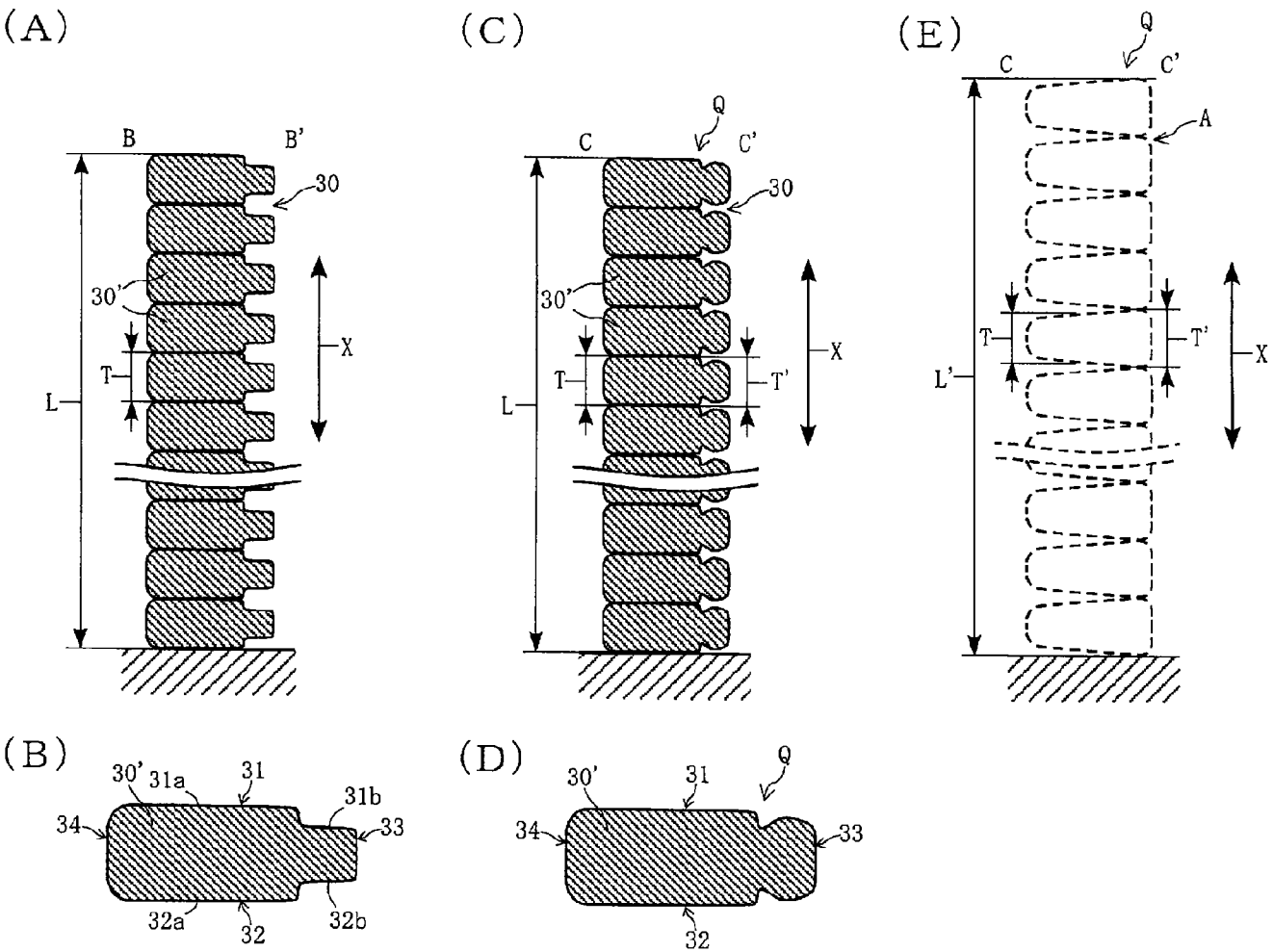
FIG. 4 is a view showing the third edgewise coil according to the third embodiment of the present invention.

FIG. 4 is a view showing the third edgewise coil 30 according to the third embodiment of the present invention. FIG. 4(A) is a cross-sectional view which is taken along the line B-B' of FIG. 1 and in which a non-circular cross-sectional shaped conductor wire 30' forming the third edgewise coil 30 is cut at a straight line part; FIG. 4(B) is an enlarged cross-sectional view of a part of FIG. 4(A); FIG. 4(C) is a cross-sectional view which is taken along the line C-C' of FIG. 1 and in which the shaped conductor wire 30' is cut at the position Q corresponding to the bending fulcrum; and FIG. 4(D) is an enlarged cross-sectional view of a part of FIG. 4(C). Here, for comparison with the conventional art, FIG. 4(E) shows, in broken lines, a cross-sectional view which is taken along the line C-C' in FIG. 9 and in which the shaped conductor wire A' forming the conventional edgewise coil A shown in FIG. 9 is cut at the position Q corresponding to the bending fulcrum.

The third edgewise coil 30 shown in FIG. 4 includes the non-circular cross-sectional shaped conductor wire 30' which has a cross-sectional shape defined by a pair of long sides 31, 32 and a pair of first and second short sides 33, 34 and which is laminated while being bended with using the first short side 33 as the bending fulcrum so as to form a plurality of laminated wire layers having a rectangular shape in a plan view, wherein the pair of long sides 31, 32, in a longitudinal cross-sectional view in a pre-bending-process state before performing the bending process, have a pair of first straight-line regions 31*a*, 31*b* respectively extending from both ends of the second short sides 34 so as to be substantially parallel to each other and a pair of second straight-line regions 31*b*, 32*b* respectively extending between the pair of first straight-line regions 31*a*, 32*a* and both ends of the first short side 33, and the pair of second straight-line regions 31*b*, 32*b* are closer to each other than the pair of first straight-line regions 31*a*, 32*a* (See FIG. 4(B)).

Fourth Embodiment

Figure 5:
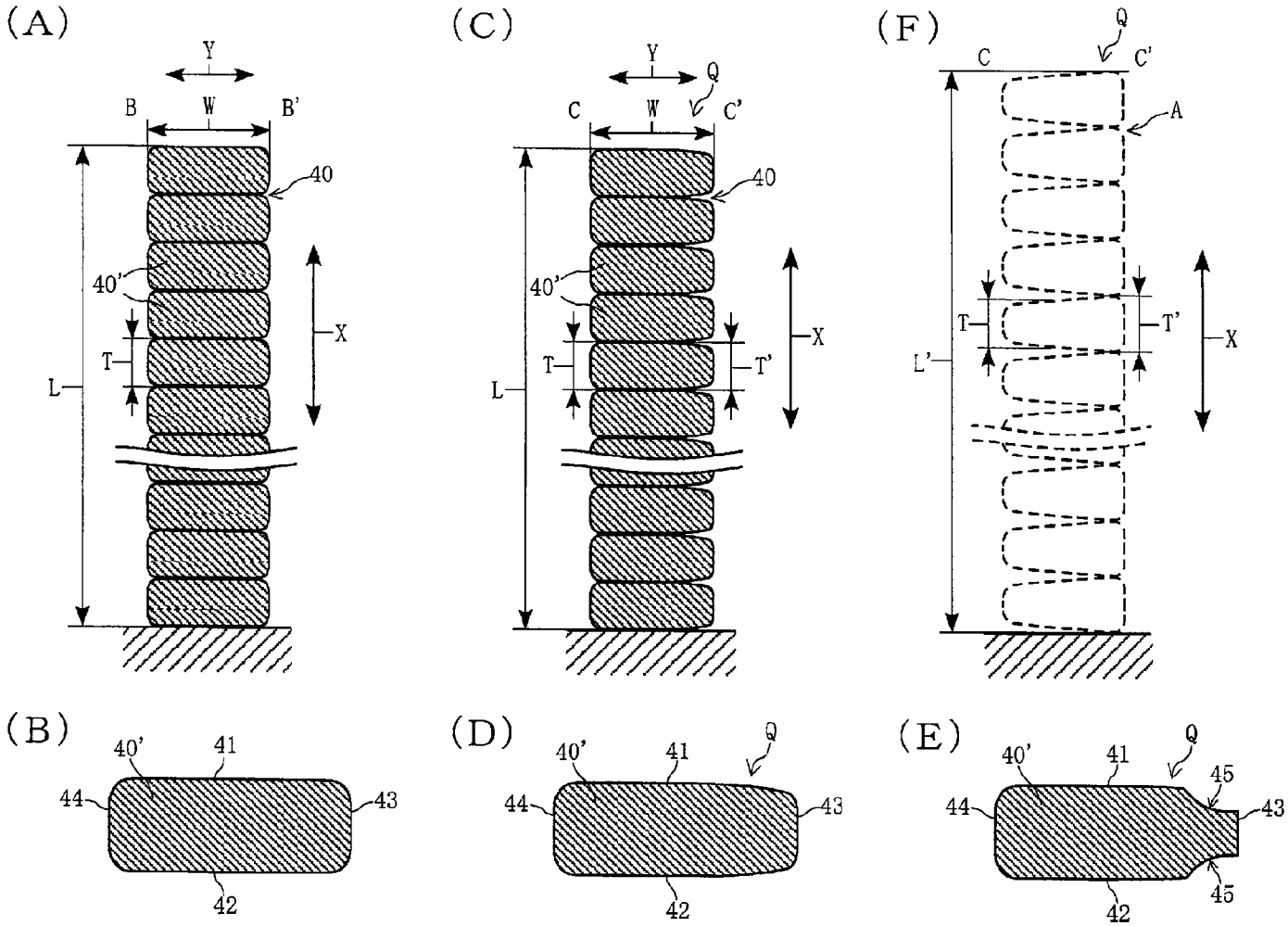
FIG. 5 is a view showing the fourth edgewise coil according to the fourth embodiment of the present invention.

FIG. 5 is a view showing the fourth edgewise coil 40 according to the fourth embodiment of the present invention. FIG. 5(A) is a cross-sectional view which is taken along the line B-B' of FIG. 1 and in which a non-circular cross-sectional shaped conductor wire 40' forming the fourth edgewise coil 40 is cut at a straight line part; FIG. 5(B) is an enlarged cross-sectional view of a part of FIG. 5(A); FIG. 5(C) is a cross-sectional view which is taken along the line C-C' of FIG. 1 and in which the shaped conductor wire 40' is cut at a predetermined position Q in a longitudinal direction Z; FIG. 5(D) is an enlarged cross-sectional view of a part of FIG. 5(C); and FIG. 5(E) is an enlarged cross-sectional view in which the shaped conductor wire 40, in the pre-bending-process state before performing the bending process, is cut at the position Q corresponding to the bending fulcrum. Here, for comparison with the conventional art, FIG. 5(F) shows, in broken lines, a cross-sectional view which is taken along the line C-C' in FIG. 9 and in which the shaped conductor wire A' of the conventional edgewise coil A shown in FIG. 9 is cut at the position Q corresponding to the bending fulcrum.

The fourth edgewise coil 40 shown in FIG. 5 includes the non-circular cross-sectional shaped conductor wire 40' which has a cross-sectional shape defined by first and second width-direction surfaces 41, 42 extending substantially parallel to each other in a state of being spaced apart from each other by T in the thickness direction (direction X in the drawing) and being along both the width direction (direction Y in the drawing) and the longitudinal direction (direction Z in the drawing) and first and second thickness-direction surfaces 43, 44 extending substantially parallel to each other in a state of being spaced apart from each other by W which is longer than T in the width direction Y and being along both the thickness direction X and the longitudinal direction Z, the shaped conductor wire 40' being laminated while being bended with using a predetermined position Q of the first thickness-direction surface 43 in the longitudinal direction Z as the bending fulcrum so as to form a plurality of laminated wire layers having a rectangular shape in a plan view, the shaped conductor wire 40', in the pre-bending-process state before performing the bending process, has a pair of recesses 45, 46 disposed at the position Q corresponding to the bending fulcrum in the longitudinal direction Z and extending from the respective first and second width-direction surfaces 41, 42 to the first thickness-direction surface 43 (See FIG. 5(E)).

Next, examples of method for producing the first to fourth edgewise coils 10, 20, 30, 40 will be described hereafter with reference to FIGS. 6 to 8.

(Examples of Method for Producing the First to Third Edgewise Coils 10, 20, 30)

Figure 6:
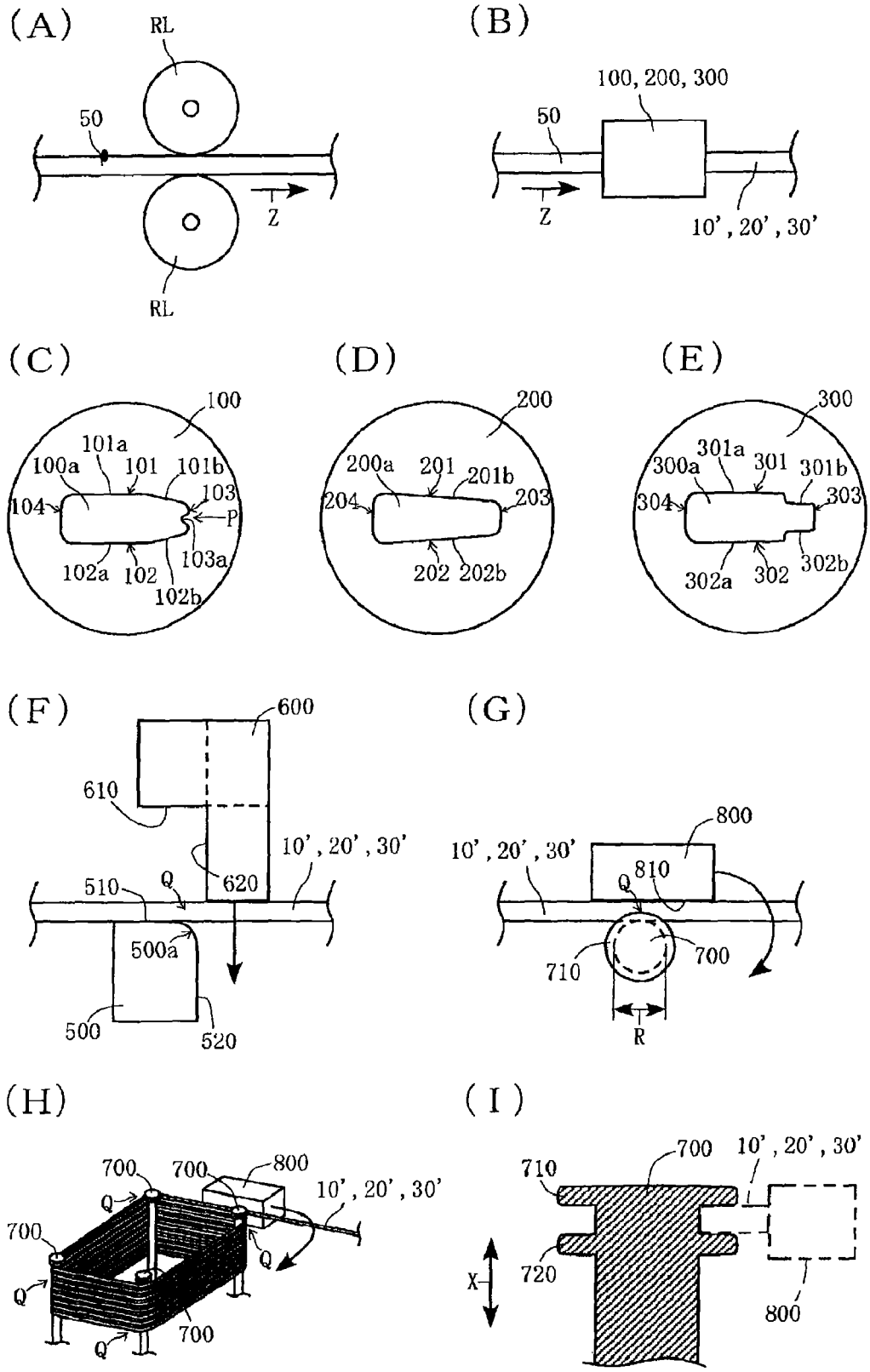
FIG. 6 is a view showing production steps and others of the first to third edgewise coils shown in FIGS. 2 to 4.

FIG. 6 is a view showing production steps and others of the first to third edgewise coils 10, 20, 30 shown in FIGS. 2 to 4. FIG. 6(A) is a schematic side view showing one example of a transporting step for transporting a mother material 50 having a circular cross-sectional shape; FIG. 6(B) is a schematic side view showing one example of a forming step for forming the first to third shaped conductor wires 10', 20', 30' from the mother material 50 having the circular cross-sectional shape with use of first to third dices 100, 200, 300; FIG. 6(C) is a schematic front view of the first dice 100 for forming the first shaped conductor wire 10' as viewed in an opening direction; FIG. 6(D) is a schematic front view of the second dice 200 for forming the second shaped conductor wire 20' as viewed in an opening direction; FIG. 6(E) is a schematic front view of the third dice 300 for forming the third shaped conductor wire 30' as viewed in an opening direction; FIG. 6(F) is a schematic plan view showing one example of a bending process step for laminating the respective first to third shaped conductor wires 10', 20', 30' while performing a bending process on them so that the respective first to third shaped conductor wires 10', 20', 30' form a plurality of laminated wire layers having a rectangular shape in a plan view; FIG. 6(G) is a schematic plan view showing another example of the bending process step; FIG. 6(H) is a perspective view showing the bending process step shown in FIG. 6(G); and FIG. 6(I) is a schematic cross-sectional view of a pin member 700 used in the bending process steps shown in FIG. 6(G) and FIG. 6(H).

The example of method for producing the first to third edgewise coils 10, 20, 30 includes:

(a) a transporting step for transporting the mother material 50 having the circular cross-sectional shape with a predetermined diameter (for example, a diameter of about 8 mm) in the longitudinal direction Z, (b) a forming step for inserting the mother material 50 having the circular cross-sectional shape through openings 100*a*, 200*a*, 300*a* of the first to third dices 100, 200, 300 respectively having first to third openings 100*a*, 200*a*, 300*a* of a predetermined shape described later, so as to form the first to third shaped conductor wires 10', 20', 30' into the non-circular cross-sectional shape defined by the pair of first and second long sides (11, 12), (21, 22), (31, 32) and the pair of first and second short sides (13, 14), (23, 24), (33, 34), and (c) a bending process step for laminating the first to third shaped conductor wires 10', 20', 30' which has been formed through the forming step while performing the bending process on the wires 10', 20', 30' with using the first short sides 13, 23, 33 as a bending fulcrum.

The first dice 100 used in the forming step in producing the first edgewise coil 10 includes an opening 100*a* which has a non-circular cross-sectional shape defined by a pair of long sides 101, 102 and a pair of short sides 103, 104 as viewed in the opening direction, wherein the pair of long sides 101, 102 have a pair of straight-line regions 101*a*, 102*a* extending substantially parallel to each other from both ends of the second short side 104 and a pair of taper regions 101*b*, 102*b* respectively extending between the pair of straight-line regions 101*a*, 102*a* and both ends of the first short side 103. The pair of taper regions 101*b*, 102*b* come closer to each other according as they approach the first short side 103. The first short side 103 is formed with a protrusion 103*a* that protrudes inward at a middle region P between the both ends, as shown in FIG. 6(C).

As shown in FIG. 6(D), the second dice 200 used in the forming step in producing the second edgewise coil 20 includes an opening 200*a* which has a non-circular cross-sectional shape defined by a pair of long sides 201, 202 and a pair of first and second short sides 203, 204 as viewed in the opening direction, wherein the pair of long sides 201, 202 have a pair of tapered regions 201*a*, 202*a* extending between both ends of the second short side 204 and both ends of the first short side 203, the pair of taper regions 201*b*, 202*b* come closer to each other according as they approach the first short side 203.

As shown in FIG. 6(E), the third dice 300 used in the forming step in producing the third edgewise coil 30 includes an opening 300*a* which has a non-circular cross-sectional shape defined by a pair of long sides 301, 302 and a pair of first and second short sides 303, 304 as viewed in the opening direction, wherein the pair of long sides 201, 202 have a pair of first straight-line regions 301*a*, 302*a* extending from both ends of the second short sides 304 so as to be substantially parallel to each other and a pair of second straight-line regions 310*b*, 302*b* extending between the pair of first straight-line regions 301*a*, 302*a* and both ends of the first short side 303, the pair of second straight-line regions 301*b*, 302*b* being closer to each other than the pair of first straight-line regions 301*a*, 302*a*.

As shown in FIG. 6(F), the bending process in the bending process step in producing the first to third edgewise coils 10, 20, 30 may be carried out with use of a press force receiving member (mold die shaft) 500 and a pressing member (mold bending member) 600. The press force receiving member 500 has a rectangular shape in plan view and includes an R part 500*a* having a circular arc shape in a plan view that is formed so as to be capable of dispersing the stress concentration generated at the time of bending the shaped conductor wire. The press force receiving member 500 is disposed so that the R part 500*a* is positioned at the bending fulcrum. The pressing member 600 has an L-letter shape in a plan view and includes two pressing surfaces 610, 620 that press the respective first to third shaped conductor wires 10', 20', 30', which are sandwiched between the pressing member 600 and the press force receiving member 500, towards two supporting surfaces 510, 520 of the press force receiving member 500 between which the R part 500*a* is positioned. In place of this method, the bending process may also be carried out with use of a pin member 700 and a pressing member 800, as shown in FIGS. 6(G) and 6(H). The pin member 700 is disposed at the bending fulcrum and has a circular outer surface of a diameter R capable of dispersing the stress concentration generated at the time of bending the shaped conductor wire. The pressing member 800 has a pressing surface 810 that press the respective first to third shaped conductor wires 10', 20', 30', which are sandwiched between the pressing member 800 and the pin member 700, towards the pin member 700 in such a manner that the respective shaped conductor wires are wound around the pin member 700.

The pressing member 600 having an L-letter shape in a plan view may be formed by a combination of three pressing member having a rectangular shape in a plan view. The pin member 700 in place of the press force receiving member 500 may be used along with the pressing member 600, or the press force receiving member 500 in place of the pin member 700 may be used along with the pressing member 800. That is, the bending process may be carried out with use of the pin member 700 and the pressing member 600 that has an L-letter shape in a plan view and includes two pressing surfaces 610, 620 that press the respective first to third shaped conductor wires 10', 20', 30', which are sandwiched between the pressing member 600 and the pin member 700, towards the pin member 700, or may be carried out with use of the press force receiving member 500 and the pressing member 800 that press the respective first to third shaped conductor wires 10', 20', 30', which are sandwiched between the pressing member 800 and the press force receiving member 500, towards the press force receiving member 500 in such a manner that the respective shaped conductor wires are wound around the press force receiving member 500 with the R part 500*a* as the bending fulcrum. These alternative explanations are also applied to the bending process in producing the fourth edgewise coil 40 shown in FIGS. 8(A) and 8(B), which are described later.

The pin member 700 preferably has first and second restriction flanges 710, 720 that respectively prevent the first to third shaped conductor wires 10', 20', 30' from expanding toward one side and the other side in the thickness direction X in performing the bending process, as shown in FIG. 6(I).

In this example of method for producing the edgewise coil, the circular conductor wire 50 first is transported along the longitudinal direction Z by a transportation apparatus such as a transportation roller RL in the transporting step (See FIG. 6(A)), and the circular conductor wire 50 is inserted respectively into the openings 100*a*, 200*a*, 300*a* of the first to third dices 100, 200, 300 so as to be formed into the first to third shaped conductor wires 10', 20', 30' having the non-circular cross-sectional shape that is defined by the pair of first and second long sides (11, 12), (21, 22), (31, 32) and the pair of first and second short sides in the forming step (13, 14), (23, 24), (33, 34) (See FIG. 6(B) to FIG. 6(E)).

Specifically, as shown in FIG. 2(B), the first non-circular cross-sectional shaped conductor wire 10' is formed so that the pair of long sides 11, 12 has, in a longitudinal cross-sectional view, the pair of straight-line regions 11*a*, 12*a* extending from the both ends of the second short side 14 so as to be substantially parallel to each other and the pair of tapered regions 11*b*, 12*b* respectively extending between the pair of straight-line regions 11*a*, 12*a* and the both ends of the first short side 13, wherein the pair of taper regions 11*b*, 12*b* come closer to each other according as they approach the first short side 13 in the longitudinal cross-sectional view, and the first short side 13 is formed with a recess 13*a* that opens outward at a middle region P between the both ends.

As shown in FIG. 3(B), the second non-circular cross-sectional shaped conductor wire 20' is formed so that the pair of long sides 21, 22 has, in a longitudinal cross-sectional view, the pair of tapered regions 21*b*, 22*b* respectively extending from the both ends of the second short side 24 and the both ends of the first short side 23, wherein the pair of tapered regions 21*b*, 22*b* come closer to each other in a longitudinal cross-sectional view as they approach 14 the first short side 23.

As shown in FIG. 4(B), the third non-circular cross-sectional shaped conductor wire 30' is formed so that the pair of long sides 31, 32 has, in a longitudinal cross-sectional view, the pair of first straight-line regions 31*a*, 32*a* extending from the both ends of the second short side 34 so as to be substantially parallel to each other and the pair of second straight-line regions 31*b*, 32*b* respectively extending between the pair of first straight-line regions 31*a*, 32*a* and the both ends of the first short side 33, wherein the pair of second straight-line regions 31*b*, 32*b* are closer to each other than the pair of first straight-line regions 31*a*, 32*a*.

Subsequently, in the bending process step, the shaped conductor wires 10', 20', 30' formed in the forming step are laminated while being bended with using the short side 13, 23, 33 as the bending fulcrum so as to form a plurality of laminated wire layers (See FIG. 6(F) to FIG. 6(I)). In this manner, the first to third edgewise coils 10, 20, 30 shown in FIG. 2 to FIG. 4 can be produced.

(Examples of Method for Producing the Fourth Edgewise Coil 40)

Figure 7:
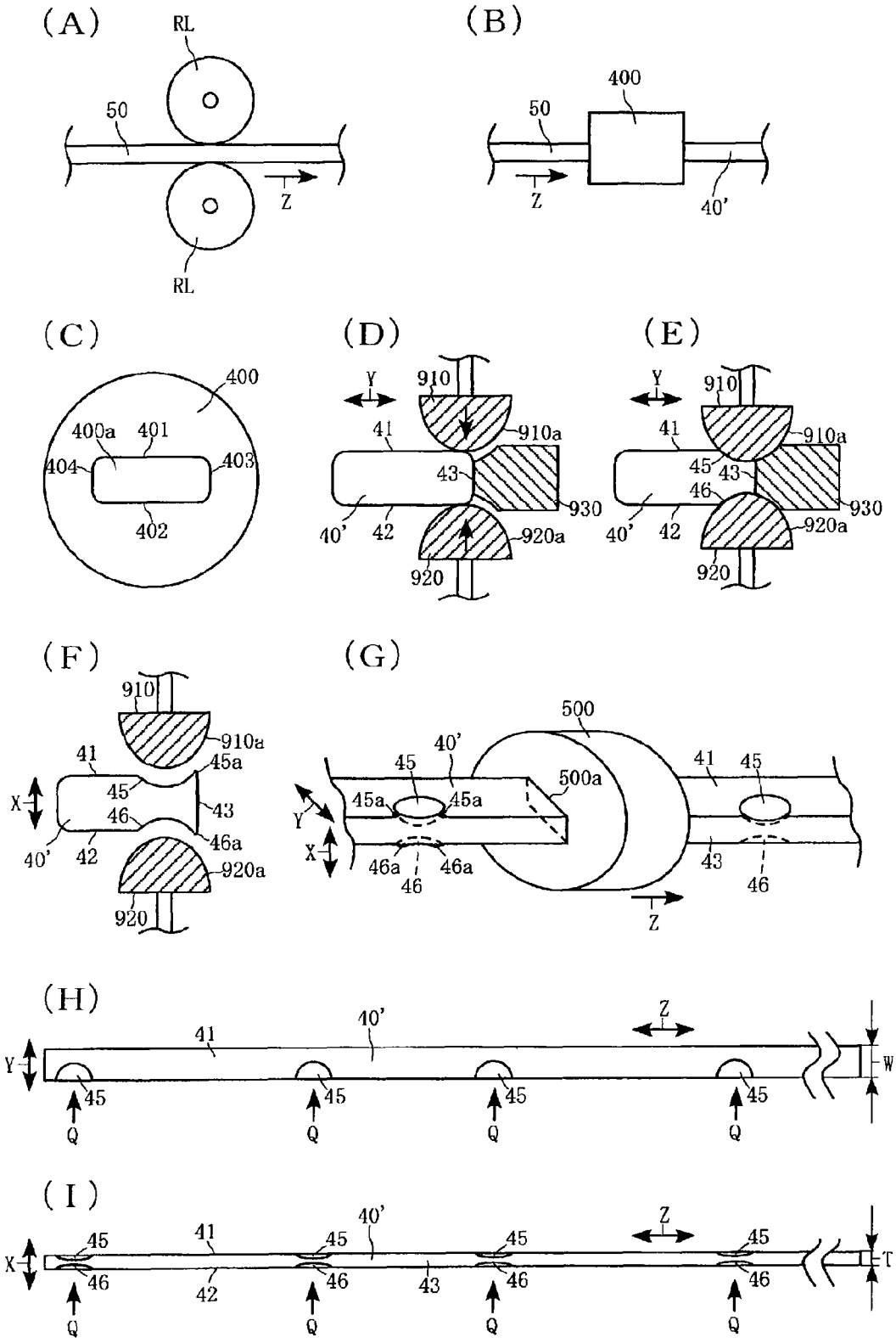
FIG. 7 is a view showing production steps and others of the fourth edgewise coil shown in FIG. 5.
Figure 8:
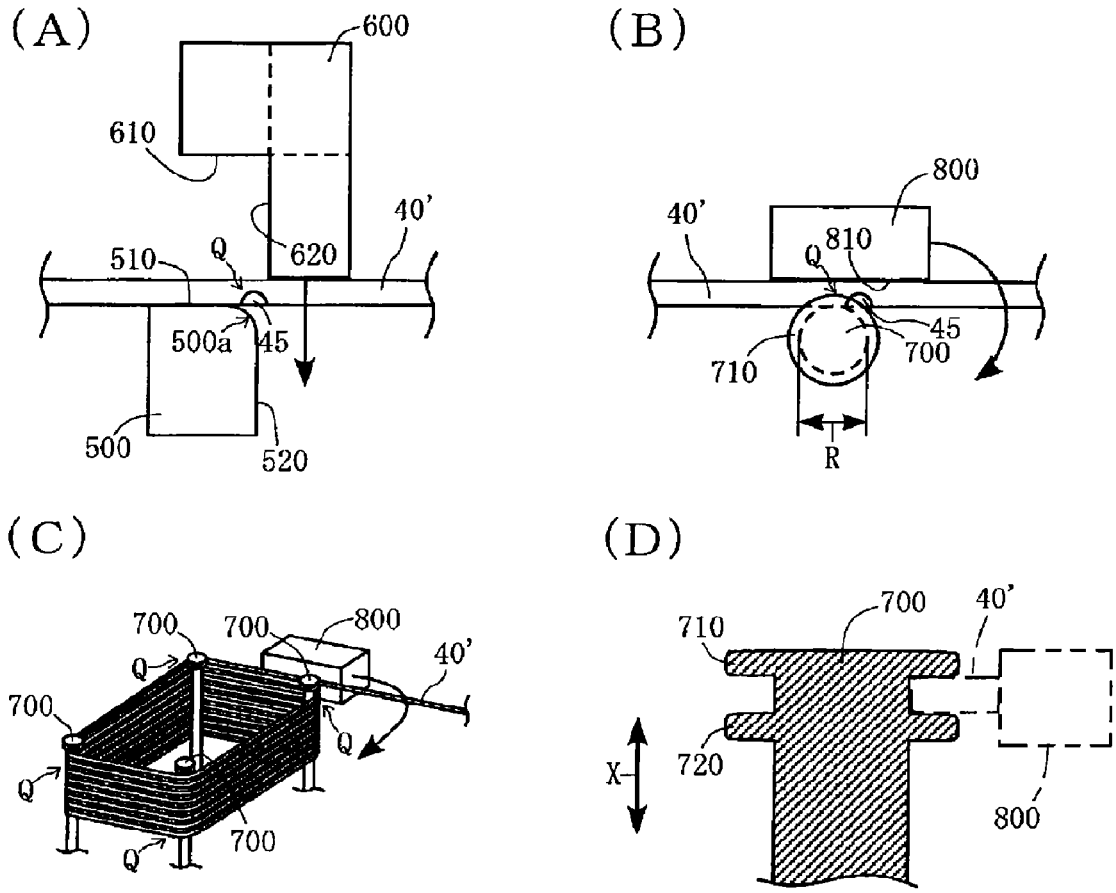
FIG. 8 is a view showing production steps and others of the fourth edgewise coil shown in FIG. 5.

FIGS. 7 and 8 are views showing production steps and others of the fourth edgewise coil 40 shown in FIG. 5. FIG. 7(A) is a schematic side view showing one example of a transporting step for transporting the mother material 50 having a circular cross section; FIG. 7(B) is a schematic side view showing one example of a forming step for forming the fourth shaped conductor wire 40' from the mother material 50 having a circular cross section with use of a fourth dice 400; FIG. 7(C) is a schematic front view of the fourth dice 400 for forming the fourth shaped conductor wire 40' as viewed in the opening direction; FIG. 7(D) is a schematic side view showing one example of a recess forming step for forming a pair of recesses 45, 46 with use of a pair of pressing members 910, 920 and a restriction member 930 and showing a state before forming the pair of recesses 45, 46; FIG. 7(E) is a schematic side view showing a state in which the pair of recesses 45, 46 are being formed; FIG. 7(F) is a schematic side view showing the other example of the recess forming step in which the pair of first and second pressing members 910, 920 respectively press first and second width-direction surfaces 41, 42 of the fourth shaped conductor wire 40' in a state that the pair of first and second pressing members 910, 920 do not extend beyond the first thickness-direction surface 43; FIG. 7(G) is a schematic perspective view showing a step for cutting apex parts 45*a*, 46*a* of the fourth shaped conductor wire 40' which are occurred on a side close to the first thickness-direction surface 43 than the pair of recesses 45, 46 in the width direction Y as a result of the formation of the pair of recesses 45, 46 by the example shown in FIG. 7(G) and; FIG. 7(H) is a schematic plan view of the shaped conductor wire 40' of the fourth edgewise coil 40 as viewed from a plane, in the pre-bending-process state before performing the bending process; and FIG. 7(I) is a schematic side view of the shaped conductor wire 40' as viewed from the first thickness-direction surface 43 side. FIG. 8(A) is a schematic plan view showing one example of a bending process step in which the fourth shaped conductor wire 40' is laminated while being bended so as to form a plurality of laminated wire layers; FIG. 8(B) is a schematic plan view showing another example of the bending process step; FIG. 8(C) is a perspective view of the bending process step shown in FIG. 8(B); and FIG. 8(D) is a schematic cross-sectional view of a pin member 700 used in the bending process step shown in FIG. 8(B) and FIG. 8(C).

The example of method for producing the fourth edgewise coil 40 includes:

(a) a transporting step for transporting a mother material 50 having a circular cross section with a predetermined diameter (for example, a diameter of about 8 mm) along the longitudinal direction Z, (b) a forming step for inserting the mother material 50 having a circular cross section through an opening 400*a* of the fourth dice 400 having a predetermined shape described later, to thereby form a elongated fourth non-circular cross-sectional shaped conductor wire 40' that has first and second width-direction surfaces 41, 42 extending substantially parallel to each other in a state of being spaced apart from each other by T in the thickness direction X and being along the width direction Y and the longitudinal direction Z and that has first and second thickness-direction surfaces 43, 44 extending substantially parallel to each other in a state of being spaced apart from each other by W which is longer than T in the width direction Y and being along the thickness direction X and the longitudinal direction Z, (c) a recess forming step for forming a pair of recesses 45, 46 at the position Q corresponding to the bending fulcrum in the longitudinal direction Z in the fourth shaped conductor wire 40' formed by the forming step, the pair of recesses 45, 46 extending respectively from the first and second width-direction surfaces 41, 42 to the first thickness-direction surface 43, and (d) a bending process step for laminating the fourth shaped conductor wire 40', on which the pair of recesses 45, 46 have been formed in the recess forming step, while being bended with using the predetermined position Q of the first thickness-direction surface 43 in the longitudinal direction Z as the bending fulcrum located so as to form a plurality of laminated wire layers.

The fourth dice 400 used in the forming step in producing the fourth edgewise coil 40 includes, as shown in FIG. 7(C), an opening 400*a* which has a non-circular cross-sectional shape defined by a pair of long sides 401, 402 and a pair of short sides 403, 404 as viewed in the opening direction.

In the recess forming step, the pair of recesses 45, 46 may be formed with use of a pair of first and second pressing members (molds) 910, 920 and a restriction member (press-mold) 930. The pressing members 910, 920 respectively have convex spherical surfaces 910*a*, 920*a*, and respectively press the first and second width-direction surfaces 41, 42 of the fourth shaped conductor wire 40' via the convex spherical surfaces 910*a*, 920*a* so that the position Q corresponding to the bending fulcrum in the longitudinal direction will be recessed most deeply, in a state where the convex spherical surfaces 910*a*, 920*a* extending beyond the first thickness-direction surface 43. The restriction member 930 is configured to prevent the shaped conductor wire 40' from expanding to a side close to the first thickness-direction surface 43 in the width direction Y when the fourth shaped conductor wire 40' is pressed by the first and second pressing members 910, 920, as shown in FIG. 7(D) and FIG. 7(E).

The pair of recesses 45, 46 may be formed by an alternative method where the pair of first and second pressing members 910, 920 respectively press the first and second width-direction surfaces 41, 42 of the fourth shaped conductor wire 40' in a state in which apex parts of the convex spherical surfaces 910*a*, 920*a* are located inner than the first thickness-direction surface 43 in the width direction so as not to extend beyond the first thickness-direction surface 43, as shown in FIG. 7(F). Although the alternative method may pose a problem that portions of the first and second width-direction surfaces 41, 42 located on a side close to the first thickness-direction surface 43 than the pair of recesses 45, 46 in the width direction Y project outward in the thickness direction X from the first and second width-direction surfaces 41, 42, resulting in the apex parts 45*a*, 46*a* on the first and second width-direction surfaces 41, 42, as shown in FIG. 7(G), the protruding apex parts 45*a*, 46*a* can be cut by inserting the fourth shaped conductor wire 40' again through an opening 500*a* of a fifth dice 500, the opening 500*a* similar to the opening 400*a* of the fourth dice 400.

As shown in FIG. 8(A), the bending process in the bending process step in producing the fourth edgewise coils 40 may be carried out with use of the press force receiving member (mold die shaft) 500 and the pressing member (mold bending member) 600. The press force receiving member 500 has a rectangular shape in plan view and includes the R part 500*a* having a circular arc shape in a plan view that is formed so as to be capable of dispersing the stress concentration generated at the time of bending the shaped conductor wire 40'. The pressing member 600 has an L-letter shape in a plan view and includes the two pressing surfaces 610, 620 that press the fourth shaped conductor wire 40', which are sandwiched between the pressing member 600 and the press force receiving member 500, towards the two supporting surfaces 510, 520 of the press force receiving member 500 between which the R part 500*a* is positioned. In place of this method, the bending process may also be carried out with use of the pin member 700 and the pressing member 800, as shown in FIGS. 8(B) and 8(C). The pin member 700 is disposed at the bending fulcrum and has a circular outer surface of a diameter R capable of dispersing the stress concentration generated at the time of bending the shaped conductor wire. The pressing member 800 has the pressing surface 810 that press the fourth shaped conductor wires 40', which are sandwiched between the pressing member 800 and the pin member 700, towards the pin member 700 in such a manner that the shaped conductor wire is wound around the pin member 700. Here, in a case where the bending process has to bend the shaped conductor wire in a direction opposite to a direction in which a mother material is bended, the pressing member 800 may have a pin shape in accordance to the mother material. By using the pressing member 800 having a shape similar to that of the pin member 700, a good bending processability can be maintained.

The pin member 700 preferably has the first and second restriction flanges 710, 720 that respectively prevent the fourth shaped conductor wire 40' from expanding toward one side and the other side in the thickness direction X in performing the bending process, as shown in FIG. 8(D).

In the example of method for producing the edgewise coil, the circular conductor wire 50 first is transported along the longitudinal direction Z by the transportation apparatus such as the transportation roller RL in the transporting step (See FIG. 7(A)), and the circular conductor wire 50 is inserted into the opening 400*a* of the fourth dice 400 so as to be formed into the elongated fourth shaped conductor wires 40' having the non-circular cross-sectional shape that is defined by the pair of first and second width-direction surfaces 41, 42 extending substantially parallel to each other so as to be space apart from each other by T in the thickness direction X and so as to be along both the width direction Y and the longitudinal direction Z and the pair of first and second thickness-direction surfaces 43, 44 extending substantially parallel to each other so as to be spaced apart from each other by W which is longer than T in the width direction Y and so as to be along both the thickness direction X and the longitudinal direction Z (See FIG. 7(B) to FIG. 7(C)).

In the recess forming step, the pair of recesses 45, 46 is formed in the fourth shaped conductor wire 40', which is formed by the forming step, at the position Q corresponding to the bending fulcrum in the longitudinal direction Z so as to respectively extend from the first and second width-direction surfaces 41, 42 to the first thickness-direction surface 43 (See FIG. 7(D) to FIG. 7(G)).

In a state after the recess forming step is carried out, the fourth non-circular cross-sectional shaped conductor wire 40' includes the pair of recesses 45, 46 that is positioned at the position Q corresponding to the bending fulcrum in the longitudinal direction Z and that respectively extends from the first and second width-direction surfaces 41, 42 to the first thickness-direction surface 43, the pair of recesses 45, 46 having a spherical shape in which the position corresponding to the bending fulcrum is recessed most deeply.

Subsequently, in the bending process step, the shaped conductor wires 40' with the pair of recesses 45, 46 formed in the recess forming step is laminated while being bended with using the predetermined position Q of the first thickness-direction surface 43 in the longitudinal direction as the bending fulcrum to form a plurality of laminated wire layers (See FIG. 8(A) to FIG. 8(D)). In this manner, the fourth edgewise coil 40 shown in FIG. 5 can be produced.

According to the first to fourth edgewise coils 10, 20, 30, 40 described above, even if the stress is concentrated on the inner circumference C' side at the time of the bending process at the position Q corresponding to the bending fulcrum due to the plastic deformation of the shaped conductor wires 10', 20', 30', 40' and an outward expansion in the thickness direction X is accordingly occurred, this expansion is occurred in the pair of taper regions (11*b*, 12*b*), (21*b*, 22*b*) in the first and second edgewise coils 10, 20; the expansion is occurred in the pair of second straight-line regions 31*b*, 32*b* in the third edgewise coil 30; and the expansion is occurred in the recess parts 45, 46 in the fourth edgewise coil 40. Therefore, the thickness T' on the inner circumference C' side can be approximated to or can be reduced to be lower than (preferably can be made approximately equal to) the thickness T of the shaped conductor wire in the pre-bending-process state. Accordingly, the gap, which may be caused due to the expansion at the position Q corresponding to the bending fulcrum, can be eliminated or can be reduced to be almost none between adjacent shaped conductor wires (10', 10'), (20', 20'), (30', 30'), (40', 40') in the laminated state, so that the closely-contacted-state length L can be shortened, and the space of an apparatus or the like on which the edgewise coils 10, 20, 30, 40 are mounted can be saved for that amount. Also, the iron core inserted into the coil can be shortened in correspondence with the closely-contacted-state length L of the edgewise coils 10, 20, 30, 40, and can be reduced in weight for that amount. Further, reduction of the costs of the members having sizes depending on the closely-contacted-state length L, such as scale reduction of the casing for housing the edgewise coils 10, 20, 30, 40, can be achieved.

Also, in the first edgewise coil 10, the first short side 13 is formed with the recess 13*a* that opens outward at the middle region P between the both ends. In the fourth edgewise coil 40, the pair of recesses 45, 46 have spherical shapes that are recessed most deeply at the position of the bending fulcrum. Therefore, the stress concentration on the inner circumference C' side at the position Q corresponding to the bending fulcrum due to plastic deformation of the shaped conductor wires 10', 40' at the time of the bending process can be dispersed so that the outward expansion of the shaped conductor wire is effectively prevented from being expanded in the thickness direction X.

Also, in the first to fourth edgewise coils 10, 20, 30, 40, in the event that the bending process is carried out by the pin member 700 disposed at the bending fulcrum, the thickness T' on the inner circumference C' side of the shaped conductor wires 10', 20', 30', 40' does not exceed the thickness T of the shaped conductor wires 10', 20', 30', 40' in the pre-bending-process state at the position Q corresponding to the bending fulcrum, because the pin member 700 has the first and second restriction flanges 710, 720 that respectively prevent the shaped conductor wires 10', 20', 30', 40' from expanding in one side and the other side in the thickness direction X in performing the bending process.

Example

The first edgewise coil 10 according to the present invention shown in FIGS. 1 and 2 and the conventional edgewise coil A shown in FIG. 9 were fabricated with the thickness T of the shaped conductor wire 10' being 2.0 mm, the width being 5.0 mm, and the number of turns in a lamination direction being 30 turns. As a result of this, the closely-contacted-state length L of the first edgewise coil 10 was 62.5 mm while the closely-contacted-state length L' of the conventional edgewise coil A was 75.5 mm, whereby the closely-contacted-state length L could be reduced by 17.2% as compared with the conventional one. This has confirmed that the space of an apparatus or the like on which the edgewise coil 10 according to the present invention is mounted can be saved, and also reduction of the costs of the members having sizes depending on the closely-contacted-state length, such as shortening and weight reduction of the iron core to be inserted and scale reduction of the casing for housing, can be achieved.

The invention claimed is:

1. An edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, wherein the pair of long sides include, in a longitudinal cross section in a pre-bending-process state before the shaped conductor wire is bended, a pair of straight-line regions extending from both ends of the second sides so as to be parallel to each other and a pair of tapered regions extending between the straight-line regions and the first short side, and the pair of tapered regions, in a longitudinal cross section in the pre-bending-process state, come closer to each other as they approach the first short side.

2. An edgewise coil according to claim 1, wherein the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

3. An edgewise coil according to claim 1, wherein the first short side, in a longitudinal cross section in the pre-bending-process state, is formed with a recess that opens outward at a middle region between its both ends.

4. An edgewise coil according to claim 3, wherein the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

5. An edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, wherein the pair of long sides include, in a longitudinal cross section in a pre-bending-process state before the shaped conductor wire is bended, a pair of tapered regions extending between both ends of the second short side and both ends of the first short side, and the pair of tapered regions, in a longitudinal cross section in the pre-bending-process state, come closer to each other as they approach the first short side.

6. An edgewise coil according to claim 5, wherein the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

7. An edgewise coil according to claim 5, wherein the first short side, in a longitudinal cross section in the pre-bending-process state, is formed with a recess that opens outward at a middle region between its both ends.

8. An edgewise coil according to claim 7, wherein the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

9. An edgewise coil which includes a non-circular cross-sectional shaped conductor having a cross-sectional shape defined by a pair of first and second long sides and a pair of first and second short sides, the shaped conductor wire being laminated while being bended with using the first short side as a bending fulcrum so as to form a plurality of laminated wire layers having a rectangular shape in a plan view, wherein the pair of long sides include, in a longitudinal cross section in a pre-bending-process state before the shaped conductor wire is bended, a pair of first straight-line regions extending from both ends of the second sides so as to be parallel to each other and a pair of second straight-line regions extending between the pair of first straight-line regions and the first short side, and the pair of second straight-line regions are closer to each other than the pair of first straight-line regions.

10. An edgewise coil according to claim 9, wherein the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

11. An edgewise coil which includes a non-circular cross-sectional shaped conductor having a cross-sectional shape defined by first and second width-direction surfaces extending substantially parallel to each other in a state of being spaced apart from each other by T in a thickness direction and in a state of being along both a width direction and a longitudinal direction and first and second thickness-direction surfaces extending substantially parallel to each other in a state of being spaced apart from each other by W which is longer than T in the width direction and in a state of being along both the thickness direction and the longitudinal direction, the shaped conductor wire being laminated while being bended with using a predetermined position of the first thickness-direction surface in the longitudinal direction as a bending fulcrum so as to form a plurality of laminated wire layers having a rectangular shape in a plan view, wherein the shaped conductor wire has, in a pre-bending-process state before the shaped conductor wire is bended, a pair of recesses disposed at a position corresponding to the bending fulcrum in the longitudinal direction, the pair of recesses respectively extending from the first and second width-direction surfaces to the first thickness-direction surface.

12. An edgewise coil according to claim 11, wherein the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

13. An edgewise coil according to claim 11, wherein the pair of recesses have spherical shapes in which the position corresponding to the bending fulcrum are recessed most deeply.

14. An edgewise coil according to claim 13, wherein the shaped conductor wire is bended with a use of a pin member disposed at the bending fulcrum, the pin member having first and second restriction flanges that respectively prevent the shaped conductor wire from expanding toward one side and the other side in the thickness direction during the conductor is bended.

* * * * *